United States Patent [19]

Morrison

[11] Patent Number: 4,502,612

[45] Date of Patent: Mar. 5, 1985

[54] DISPENSING CONTAINER

[75] Inventor: David E. Morrison, London, Canada

[73] Assignee: Saxon Arms, Inc., Clearwater, Fla.

[21] Appl. No.: 414,878

[22] Filed: Sep. 3, 1982

[30] Foreign Application Priority Data

Feb. 23, 1982 [CA] Canada ..... 396797

[51] Int. Cl.[3] ..... B65D 83/04

[52] U.S. Cl. ..... 221/185; 221/288; 221/307; 206/540; 224/239; 224/914

[58] Field of Search ..... 206/528, 540; 221/185, 221/288, 289, 301, 307, 263, 311; 224/226, 228, 239, 914

[56] References Cited

U.S. PATENT DOCUMENTS

| | | | |
|---|---|---|---|
| 1,850,606 | 3/1929 | Smith | 222/517 X |
| 2,837,258 | 4/1956 | Williams | 221/289 |
| 2,886,208 | 5/1956 | Sinclair | 221/288 |
| 2,962,190 | 11/1960 | Horland | 221/263 |
| 3,053,383 | 9/1962 | Kahn | 206/540 |

FOREIGN PATENT DOCUMENTS

| | | | |
|---|---|---|---|
| 2807011 | 8/1979 | Fed. Rep. of Germany | 221/288 |
| 837054 | 2/1939 | France | 221/288 |
| 1075697 | 7/1967 | United Kingdom | 221/263 |

*Primary Examiner*—Joseph J. Rolla
*Assistant Examiner*—Lawrence J. Miller
*Attorney, Agent, or Firm*—Basile, Weintraub & Hanlon

[57] ABSTRACT

A dispensing container for dispensing articles one at a time. The dispensing container includes a hollow body for storing articles. A delivery throat forming a continuous depending extension of the body has a cross section proximate the cross section of the articles disposed in the hollow body to serially align the articles passing therethrough from the hollow body. The throat is formed with an upturned end defining a lower trap portion adjacent the end which permits only one article at a time to be moved to the end of the throat. An outlet aperture is formed at the end of the throat. A closure member is mounted at the end of the throat for movement between a first position closing the outlet aperture and a second position opening the outlet aperture.

9 Claims, 2 Drawing Figures

DISPENSING CONTAINER

BACKGROUND OF THE INVENTION

1. Field Of The Invention

This invention relates, in general, to containers and, more specifically, to containers having means for dispensing articles from the interior thereof.

2. Description Of The Prior Art

Containers which include means for dispensing small articles, such as pills, tablets, etc., are well known. Such containers typically include a closure member or cover which is moved to open an outlet in the container to permit the discharge of articles from the interior of the container singly or in succession. Such containers also include a narrow delivery portion or throat for aligning the articles serially so as to enable the articles to be discharged from the container in succession.

It is also known to construct containers which are adapted to discharge articles one at a time. Such containers include a specially designed flap or closure member which is operative to receive one article from the interior of the container at a time and to dispense the single article when moved to an open position. However, such specially designed flaps or closure members increase the cost of such containers due to their complexity.

Such previously designed dispensers and containers have also been difficult to use with rounded articles, such as pellets, balls, etc., due to the tendency of such articles to roll under the influence of gravity, thereby causing a large number of articles to roll out of the container when the flap or cover member is moved to the open position.

Thus, it would be desirable to provide a dispensing container which is operative to dispense a single article at a time. It would also be desirable to provide a dispensing container for dispensing single articles having a substantially rounded shape. It would also be desirable to provide a dispensing container for dispensing single articles which may be worn by a user and mounted with the outlet disposed in a downward orientation. Finally, it would be desirable to provide a dispensing container which is inexpensive to manufacture.

SUMMARY OF THE INVENTION

There is disclosed herein a unique dispensing container for dispensing articles one at a time. The dispensing container includes a hollow body for storing articles. A throat or delivery portion is connected to the hollow body and forms a continuous depending extension thereof. The throat has a cross section proximate the cross section of the articles to be stored therein so as to serially align the articles passing therethrough from the hollow body. The throat is also formed with an upturned end portion in the same general plane as the hollow body defining a lower trap adjacent the end of the throat which permits only one article at a time to be moved to the end of the throat. An outlet aperture is formed at the end of the throat to permit the discharge of only a single article from the container at a time. A closure member is mounted at the end of the throat for movement between a first position closing the outlet aperture and a second position opening the outlet aperture.

In a preferred embodiment, the hollow body and throat are formed by a planar member to which is affixed a cover having an internal cavity and a depending channel portion. A pivotal flap formed in the planar member adjacent the end of the throat defines the closure for the outlet aperture in the throat. Biasing means in the form of a resilient member are secured around a lower portion of the planar member to bias the flap to the first, closed position.

The unique dispensing container of the present invention enables articles and, in particular, rounded articles such as ammunition or shot, to be dispensed one at a time. The dispensing container is attachable on the wearer which provides a convenient means for transporting the articles and enables only one hand to be used to dispense a single article from the container. Finally, the dispensing container of the present invention is formed of a few, easily manufactured components so as to be relatively inexpensive to manufacture.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
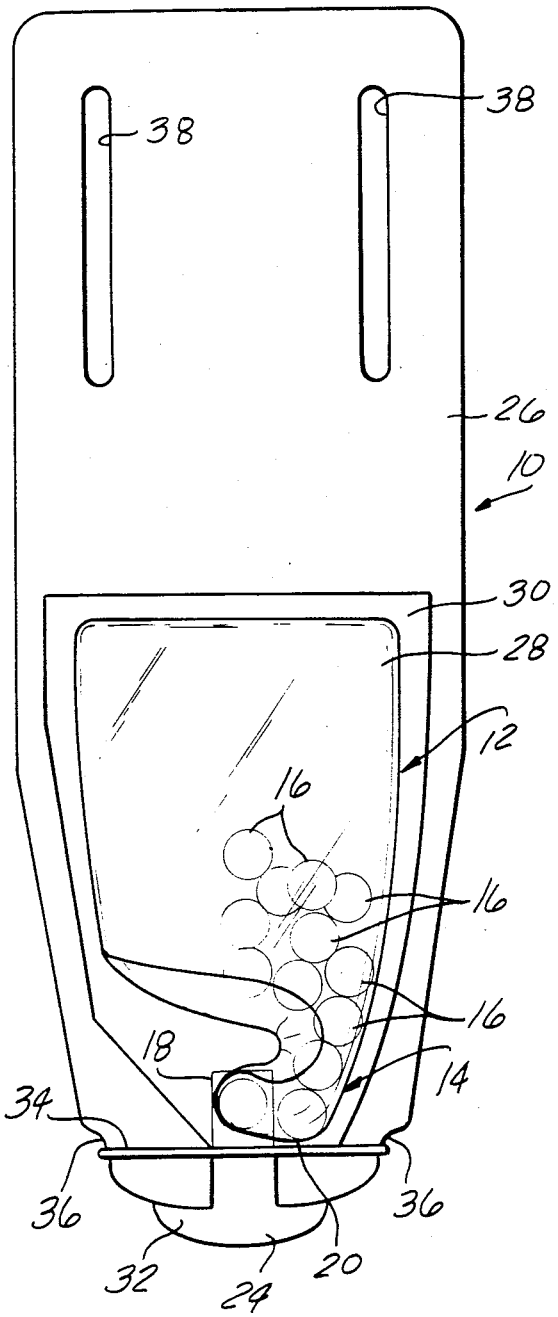
FIG. 1 is a front elevational view of the dispensing container of the present invention.

Throughout the following description and drawing, an identical reference number is used to refer to the same component shown in multiple figures of the drawing.

Figure 2:
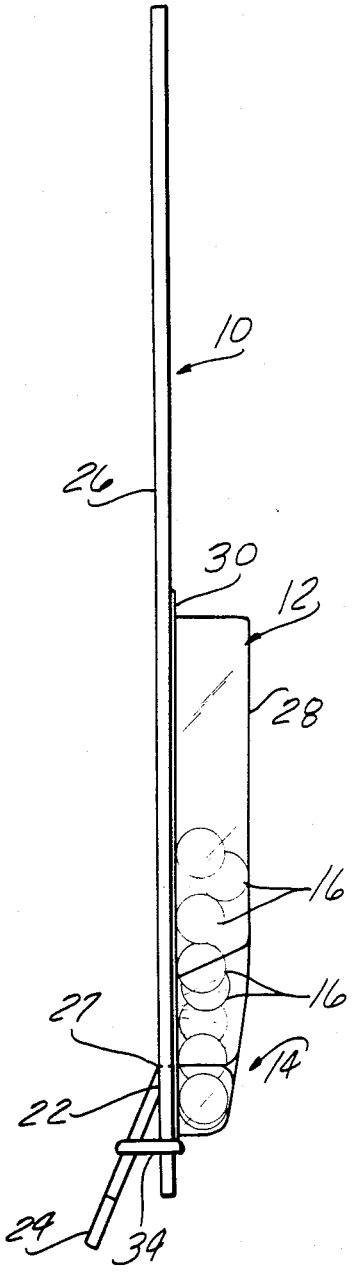
FIG. 2 is a side view of the dispensing container illustrated in FIG. 1.

Referring now to FIGS. 1 and 2 of the drawing, there is illustrated a dispensing container 10 for carrying and dispensing articles one at a time.

Although the dispensing container 10 of the present invention may be constructed so as to carry and dispense articles having an infinite number of shapes and sizes, in a preferred embodiment, the dispensing container 10 is adapted for carrying and dispensing articles having a substantially rounded shape, such as balls or shot which are used as slingshot ammunition. It will be understood that the dispensing container 10 of the present invention may be formed in a variety of sizes so as to correspond to the particular size of the ammunition or shot to be stored therein.

As shown in FIGS. 1 and 2, the dispensing container 10 includes a hollow body 12 for storing a plurality of articles 16. A delivery throat 14 is connected to the hollow body 12 and forms a continuous depending extension of the hollow body 12. The throat 14 has a cross section proximate the cross section of the articles 16 stored within the hollow body 12 so as to serially align the articles 16 passing therethrough from the hollow body 12.

The throat 14 is formed with an upturned end portion 18 disposed in the same general plane as the hollow body 12 which defines a lower trap 20 adjacent the end 18. The trap 20 permits only one article 16 at a time to be moved to the end 18 of the throat 14. The throat 14 is also formed with an outlet aperture 22 at the end 18, as shown in FIG. 2.

The dispensing container 10 of the present invention further includes a closure member 24 which is mounted at the end 18 of the throat 14 for movement between a first position closing the outlet aperture 22 and a second position, illustrated in FIG. 2, opening the outlet aperture 22.

In a preferred embodiment, the dispensing container 10 includes an elongated, substantially flat planar member 26 formed of a suitable lightweight material, such as paper or plastic. The dispensing container 10 also includes a cover member 26 having a cup-like internal cavity 28 bounded by flanges 30 formed along the periphery thereof. The cover member 26 has an elongated channel portion which depends from and communicates with the internal cavity 28. Preferably, the cover member 26 is formed of a suitable material, such as a plastic and, preferably, a transparent plastic which enables the number of articles 16 remaining in the container 10 to be easily ascertained. The cover member 26 is affixed to a lower portion of the planar member 26 by means of adhesive applied to the peripheral flanges 30. In this manner, the cover member 28 defines the hollow body 12 and throat 14 of the dispensing container 10 when secured to the planar member 26.

As described above, the throat 14 is formed with a cross section selected to be proximate the cross section of the articles 16 which are to be stored in the hollow body 12. The cross section of the throat 14 is slightly larger then the cross section of the articles 16 so as to enable the articles 16 to easily move or roll therethrough.

As shown more clearly in FIG. 2, the throat 14 has a gradually decreasing cross section along its length from the hollow body 12 to the end 18. In this manner, the throat 14 functions to serially align the articles 16 as the articles 16 pass therethrough. This is necessary since the articles 16 are typically randomly stacked within the hollow body 12, in some instances several deep.

As noted above, the end 18 extends upward from an intermediate portion of the throat 14 to define a trap 20. The trap 20 is operative to hold the articles 16 in a stationary position within the throat 14 while the flap or closure member 24 is being moved to the open position to dispense only the article 16 positioned at the end portion 18 of the throat 14. After the article 16 has been dispensed and the flap 24 moved to the first position closing the outlet aperture 22, subsequent movement of the dispensing container 10 will cause the articles 16 to move downward through the throat 14 until a new article 16 is positioned at the end portion 18 of the throat 14.

In a preferred embodiment, the closure member 24 is in the form of a pivotal flap which is secured to the planar member 26 at one end 27 adjacent the outlet aperture 22. The flap 24 includes an outer tab portion 32 which is adapted to be grasped to move the flap 24 between the open and closed positions.

To ensure that the flap or closure member 24 is retained in the closed position, biasing means 34 are provided. The biasing means 34 are operative to bias the closure member 24 to the first or closed position. In a preferred embodiment, the biasing means 34 comprises a resilient member, such as a rubber band, which is secured around the planar member 26 and seats in notches 36 formed on opposed sides of the lower portion of the planar member 26. The resilient member 34 extends across the planar member 26 and engages the flap or closure member 24 so as to bias the flap 24 to the first position closing the outlet aperture 22. Force exerted on the closure member 24 sufficient to overcome the biasing force of the resilient member 34 will enable the flap 24 to be moved to the second position illustrated in FIG. 2 thereby opening the outlet apertures 22 and permitting a single article 16 to be dispensed from the container 10.

The dispensing container 10 further includes means for attaching the container 10 to a wearer such that the throat 14 is disposed in a downward extending orientation. In a preferred embodiment, the means for attaching the dispensing container 10 on a wearer comprise a pair of spaced, substantially parallel slots 38 which are formed in an upper portion of the planar member 26. The slots 38 slidably receive a belt of the wearer which enables the dispensing container 10 to be attached to the wearer for transporting and dispensing the articles 16.

Thus, there has been disclosed a unique dispensing container which is operative to dispense articles one at a time. The dispensing container of the present invention is particularly adapted for transporting and dispensing articles having a substantially rounded shape and includes a throat having a lower trap portion which permits only a single article at a time to be positioned at the outlet aperture in the throat for discharge from the container when the closure member is moved to an open position. The dispensing container of the present invention is also adapted to be worn or attached to a wearer thereby providing a convenient means for transporting and dispensing articles. Finally, the dispensing container is formed of a small number of inexpensive components thereby contributing to a low manufacturing cost.

What is claimed is:

1. A dispensing container comprising:

a hollow body for storing articles;

a curvilinear throat forming a continuous hollow extension of the body depending from the body when the body is oriented in an operative vertical dispensing position, the throat having a cross-section proximate the cross-section of the articles the throat having an end and lower trap portion adjacent the end, the end being disposed at an upwardly extending serial alignment portion contiguous to the hollow body, a trap portion contiguous with the serial alignment portion and an article dispensing positioning portion contiguous to and extending upwardly from the trap portion in the same plane as the hollow body at an acute angle with respect to the trap portion such that only one article at a time moves to the article dispensing position from the trap, the throat further having an outlet aperture contiguous to the article dispensing positioning portion; and a closure member mounted at the outlet aperture for movement between a first position closing the outlet aperture and a second position opening the outlet aperture.

2. The dispensing container of claim 1 wherein the throat has a gradually decreasing cross-section along its length from the hollow body to the upwardly extending article dispensing portion.

3. The dispensing container of claim 1 further including means for biasing the closure to the first position closing the outlet aperture.

4. The dispensing container of claim 1 further including:

an elongated planar member; and a cover member having an internal cavity, an elongated channel portion depending from the internal cavity, and a peripheral flange defining outer edges;

the cover member being affixed to the planar member at the peripheral flange to define the hollow body and throat.

5. The dispensing container of claim 4 further including means for attaching the planar member on a user with the throat disposed in a downward extending position.

6. The dispensing container of claim 5 wherein the attaching means comprises a pair of spaced, substantially parallel slots formed in the planar member for slidingly receiving a belt of a user.

7. A dispensing container comprising:

a hollow body for storing articles;

a throat forming a continuous extension of the body and depending from the body when the body is oriented in an operative vertical dispensing position;

the throat having a cross-section proximate the cross-section of the articles to serially align the articles passing therethrough from the hollow body, the throat having an end and a lower trap portion adjacent the end, the end being disposed at an upwardly extending acute angle with respect to the trap portion such that only one article at a time moves to the end from the throat, the throat further having an outlet aperture formed at the end thereof;

an elongated planar member;

a cover member having an internal cavity and an elongated channel portion depending from the internal cavity;

the cover member being affixed to the planar member to define the hollow body and throat;

a closure member defined by a flap pivotally attached to the planar member at the end adjacent the outlet aperture; and the closure member mounted at the end of the throat for movement between a first position closing the outlet aperture and a second position opening the outlet aperture.

8. The dispensing container of claim 7 further including a resilient member secured around and engaging the flap and the planar member to bias the flap to the first position closing the outlet aperture.

9. A dispensing container comprising:

a elongated planar member;

a cover member having an internal cavity and an elongated channel portion depending from the internal cavity terminating in an upturned end;

the cover member being affixed to the planar member to define a hollow body and a depending continuous throat;

the throat having an upturned end defining a lower trap portion adjacent the end which permits only one article at a time to be moved to the end of the throat, the throat having an outlet aperture formed at the end thereof;

a closure member pivotally connected to the planar member at one end adjacent the outlet aperture in the throat for movement between a first position closing the outlet aperture and a second position opening the outlet aperture; and means, mounted on the planar member and engaging the closure member, for biasing the closure member to the first position closing the outlet aperture.

* * * * *